United States Patent [19]

Davis

[11] Patent Number: 4,746,868

[45] Date of Patent: May 24, 1988

[54] SPARK PLUG AND WIRE TESTING UNIT

[76] Inventor: Jack D. Davis, 402 E. Mary St., Valdosta, Ga. 31601

[21] Appl. No.: 825,331

[22] Filed: Feb. 3, 1986

[51] Int. Cl.[4] ..... F02P 17/00

[52] U.S. Cl. ..... 324/400; 324/383

[58] Field of Search ..... 324/378, 383, 384, 393, 324/395, 397, 398, 400, 402

[56] References Cited

U.S. PATENT DOCUMENTS

| | | | |
|---|---|---|---|
| 1,365,972 | 1/1921 | Finn | 324/397 |
| 1,383,476 | 7/1921 | Marquardt | 324/400 |
| 1,487,852 | 3/1924 | Hanauer | 324/396 |
| 1,521,041 | 12/1924 | Opsahl | 324/400 |
| 2,323,931 | 7/1943 | Peters | 324/402 X |
| 3,828,246 | 8/1974 | Maynard | 324/398 |

*Primary Examiner*—Reinhard J. Eisenzopf
*Assistant Examiner*—Jack B. Harvey
*Attorney, Agent, or Firm*—Paul H. Gallagher

[57] ABSTRACT

A metal plate is mounted on the engine head in electrical conductive relation. An electrode test unit is mounted on the metal plate, having a pair of electrodes forming a spark gap, one contacting the plate and the others adapted for securement thereto of the spark plug wire. Each spark plug can be removed individually from the engine and mounted in the plate in electrical conductivity therewith. The spark wire can then be selectively secured to the electrode unit or the spark plug, and the operator's hands are free to turn the engine. The plate is left mounted on the engine permanently.

3 Claims, 1 Drawing Sheet

SPARK PLUG AND WIRE TESTING UNIT

FIELD OF THE INVENTION

The invention relates to testing for spark plugs and wiring in an engine, such as in an automobile or lawnmower. Heretofore such testing was done by removing a spark plug from the engine head, and then with one hand holding the spark plug against the engine head, and with the other hand turning the engine to generate a voltage output. Such manipulation is extremely difficult, and moreover it could not be determined whether any defect that did exist resided in the spark plug or in the wiring.

OBJECTS OF THE INVENTION

A broad object of the invention is to provide a testing unit for use in testing spark plugs and wiring in an engine.

Another object is to provide a testing unit of the foregoing character in the use of which a spark plug can be mounted in observation position, so that the user is free of holding it, and can easily perform manipulations for testing it.

Still another object is to provide a testing unit of the foregoing character that is of extremely simple construction, and thereby is inexpensive to make, and can be left mounted in position permanently on the engine head.

DESCRIPTION OF A PREFERRED EMBODIMENT

Figure 1:
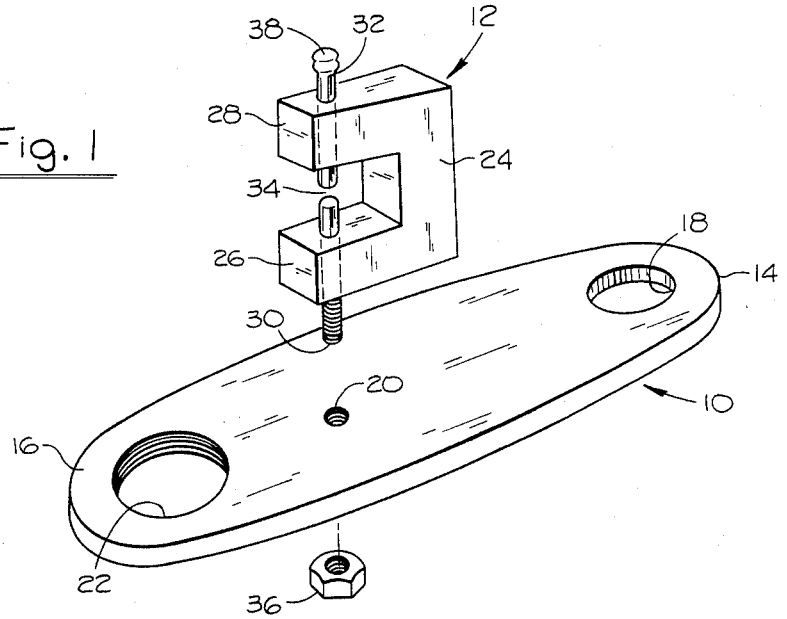
FIG. 1 is a perspective view of the engine testing unit of the invention, shown in exploded form.

Reference is made first to the field in which the invention lies. Heretofore great difficulty was encountered in testing spark plugs and the wiring thereof. When the engine was found missing, the spark plugs were tested, a spark plug was removed and held in one hand, and then the operator would use the other hand to turn the engine for producing the usual voltage. Upon the voltage being thus produced, in the case of a good plug and wiring, current would flow, and a spark across the spark gap in the spark plug would follow. This kind of manipulation involved two problems, one was holding the spark plug in one hand and manipulating the engine with the other hand, which was difficult and awkward, and the other was that when a spark was not produced in the spark plug gap, the operator would not know whether the defect resided in the spark plug itself, or in the wiring. The device of the present invention overcomes both of these difficulties in a very simple manner.

Reference is made to the specific construction of the engine testing unit of the invention. The unit includes two components, a mounting plate 10 and an electrode unit 12. The mounting plate 10 is of steel and thus electrically conductive, and has what will be referred to for convenience as a near end 14 and a remote end 16. The mounting plate is a simple, flat plate without protruding elements, and such a plate of the following dimensions has been found convenient—4" long, 1" wide and $\frac{1}{8}$" thick. Obviously these dimensions are not limiting or critical.

The plate has an untrapped hole 18 at its near end, untapped hole 20 adjacent its mid portion and a tapped hole 22 at its remote end.

The electrode unit 12 includes a body 24 of electrically non-conductive and heat resistant material. It includes a pair of parallel arms 26, 28, mounted in which are a pair of electrodes, including an inner electrode 30 and an outer electrode 32. The electrodes have inner ends approaching each other, but spaced apart, forming a spark gap 24. The outer end of the inner electrode 30 is threaded, and this end is fitted in the middle hole 20 in the plate, and a nut 36 is threaded thereon, securing the unit 12 to the plate. The spark gap 34 has characteristics similar to those of the spark gaps of the spark plugs.

The outer end of the outer electrode 32, indicated at 38, is provided with a fitting 39 adapted for connection thereto of a wire normally leading to the spark plug.

Figure 2:
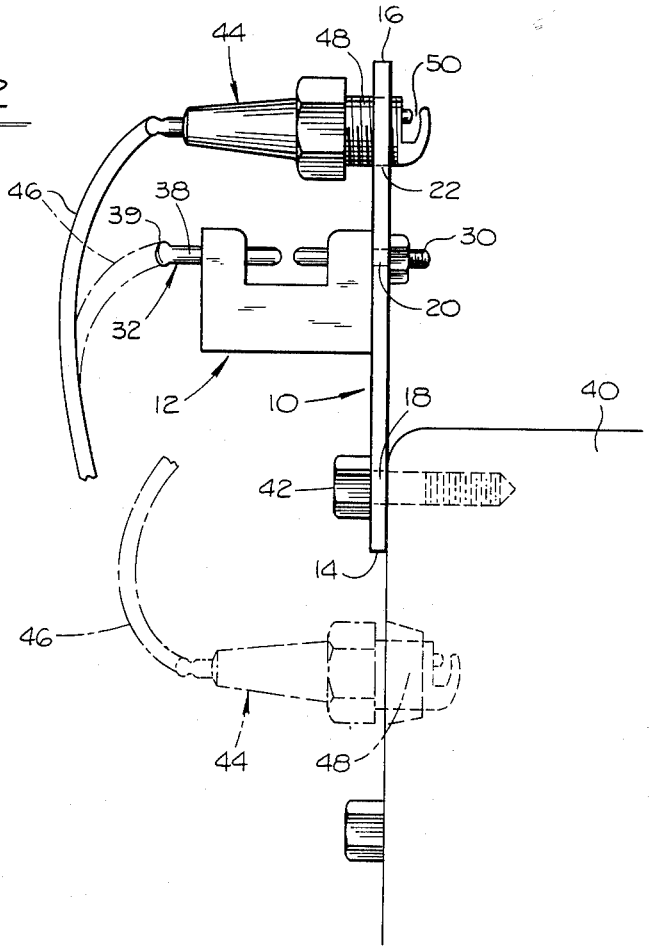
FIG. 2 is a side view of the unit mounted on the engine and showing a fragment of the engine.

FIG. 2 shows a fragment of the engine, indicated at 40, which includes a mounting bolt 42 as a normal element of the engine. The engine test unit is mounted to the engine 40 by removing the bolt 42 and then fitting the mounting plate 20 to the engine, inserting the bolt again through the hole 18 and into the engine securing the plate rigidly to the engine. The near end 14 is thus adjacent to the engine and the remote end 16 is extended from the engine.

With the mounting plate thus secured in position, it carries the electrode unit 12 which is positioned also at a distance from the engine, although exposed and free to access on the outer side of the mounting plate.

FIG. 2 shows one of the spark plugs of the engine in dot-dash lines, indicated at 44, mounted in the engine. A wire element 46 is connected with the spark plug, this wire element constituting an element of the standard wiring system of the engine.

The spark plug has a threaded base 48 and can be mounted on the mounting plate by threading the base in the tapped hole 22. It will be noted that the spark plug has the usual spark gap 50.

The mounting plate 10 has grounded contact engagement with the engine 40, the inner electrode 30 has grounded electrical contact with the plate 10, and the spark plug has grounded electrical contact with the mounting plate through the threaded base 48.

When it is desired to test the spark plug, tests are made in the two phases referred to above, namely the spark plugs and the wiring. Each plug is removed individually from its normal place in the engine, and then mounted on the mounting plate as shown in FIG. 2. Then the wire 46 is re-attached to the spark plug in its new position as indicated in FIG. 2. The spark plug is thus mounted securely and independently of holding by the operator, that is, the operator's hands are free for other uses. He then turns the engine manually, and observes whether a spark occurs in the spark plug. The spark plug is mounted for clear observation, providing an advantage in addition to the operator's hands being free for so turning the engine.

If the spark occurs in that spark plug, the operator replaces it in the operating position and tests another one, but if a spark does not develop in the spark gap 50 of the spark plug when so tested, the operator removes the wire 46 from the spark plug and attaches it to the outer electrode 22 of the electrode unit and again turns the engine. If a spark develops at the spark gap 34, the operator then knows that the spark plug is faulty, but that the wiring is not. On the other hand, if no spark develops at the spark gap 34 as well, the operator knows that the defect is not in the spark plug, but in the wiring, or the generator, or other instrumentalities or components.

The unit may remain permanently secured to the engine, the unit then consisting of the mounting plate 10 and the electrode unit 12, that is, of course without the spark plug. The device is very small and occupies little space and therefore can easily be accommodated in its mounted position. The great advantage of this of course is it need not be mounted new for each testing operation.

Its small size serves to adapt it readily to engines of virtually any size or shape, including as examples automobile engines, lawnmower engines, etc. The mounting plate 10 may be of any desired size or shape for positioning the spark plug 24 when it is secured thereto, in a convenient position, and in an observable position, so that the operator can readily view it as he is turning the engine.

I claim:

1. A spark plug and wire testing unit for use with an engine having a head and including spark plugs with spark gaps and each having an element in electrical contact with the engine, the engine also including an ignition system having wires leading individually to the spark plugs and normally detachably connected thereto, the testing unit comprising, a mounting plate of electrically conductive material having a near end and a remote end, and having mounting means at the near end for mounting on the engine, and mounting means at the remote end for mounting a spark plug on the mounting plate, the mounting plate when mounted on the engine being in electrical contact engagement therewith, and the spark plug when mounted on the mounting plate having its said element in electrical contact engagement with the mounting plate and with its spark gap exposed to view, an electrode unit mounted on the mounting plate and including a body of block-like form with a pair of parallel arms including an inner arm and an outer arm, spaced apart and having outer broad surfaces, the electrode unit being so mounted with the outer surface of the inner one of the parallel arms engaging the mounting plate and the arms thereby disclosed parallel with the mounting plate, the electrode unit including inner and outer electrodes mounted in the inner and outer parallel arms respectively, and forming a spark gap therebetween positioned in the space between the parallel arms and exposed to view, the inner electrode extending through the inner parallel arm in which it is mounted and operable for securing the electrode unit to the mounting plate, and being in electrical contact engagement with the mounting plate, and the outer electrode extending through the outer parallel arm in which it is mounted and having means for detachably connecting a wire normally connected with a said spark plug.

2. A spark plug and wire testing unit according to claim 1 wherein, the mounting plate is constituted by a flat plate lying entirely within planes defining its opposite sides, and the mounting means thereon consist only in holes therethrough.

3. A spark plug and wire testing unit according to claim 2 wherein, certain of the holes are threaded, and certain of them are non-threaded.

* * * * *